US005314343A

United States Patent [19]

Englander

[11] Patent Number: 5,314,343

[45] Date of Patent: May 24, 1994

[54] GROUNDING STRAP

[75] Inventor: Sol Englander, Jamaica, N.Y.

[73] Assignee: Rosco, Inc., Jamaica, N.Y.

[21] Appl. No.: 85,027

[22] Filed: Jun. 30, 1993

[51] Int. Cl.[5] ..... H01R 4/38; H01R 4/66

[52] U.S. Cl. ..... 439/100; 439/795; 439/800; 24/278

[58] Field of Search ..... 439/100, 795, 799, 800; 24/19, 274 WB, 278

[56] References Cited

U.S. PATENT DOCUMENTS

| | | | |
|---|---|---|---|
| 1,505,314 | 8/1924 | Cox | 439/800 |
| 2,114,752 | 4/1938 | Tallman | 439/795 |
| 3,353,145 | 11/1967 | Sodderland et al. | 24/278 |
| 4,591,229 | 5/1986 | Sachs | 439/795 |

*Primary Examiner*—Gary F. Paumen

*Attorney, Agent, or Firm*—Ostrolenk, Faber, Gerb & Soffen

[57] ABSTRACT

A grounding strap including a strap of flexible, electrically conductive material, the strap having a plurality of holes therethrough spaced equidistantly along a portion of the strap, a threaded nut fastened to the strap at an aperture in the strap at a location near one end thereof, a projection near the one end for engaging a hole in the strap when the strap is wrapped around a grounded member such that the portion with the hole engaging the projection is on top of the portion of the strap having the projection, the holes in the strap being spaced so that when a first hole in the strap is above the projection, a second hole in the strap is approximately above the threaded nut, a separate member loosely fastened to the strap and positioned near the nut and being arranged such that a surface of the member is disposed below the nut, the nut receiving a tightening screw, whereby when the strap is wrapped about the grounded member, the screw is insertable through the second hole and screwable into the nut so as to bear down on the surface of the member, forcing the nut upwardly away from the member and tightening the strap around the grounded member.

14 Claims, 1 Drawing Sheet

FIG. 2.
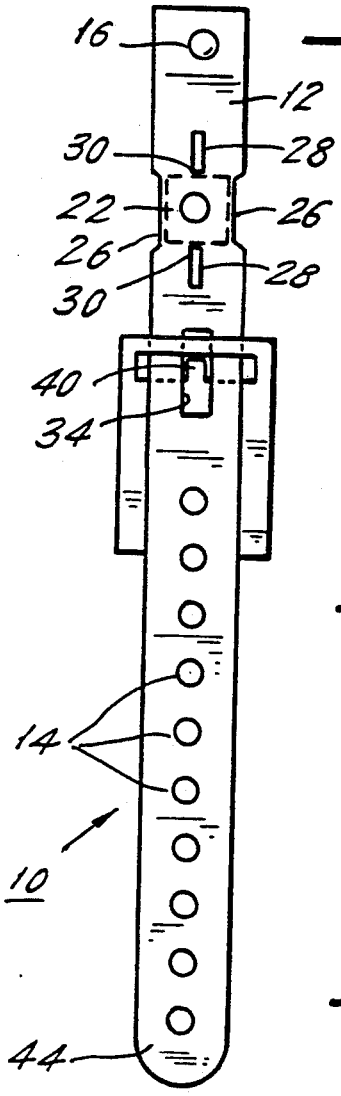
FIG. 3.
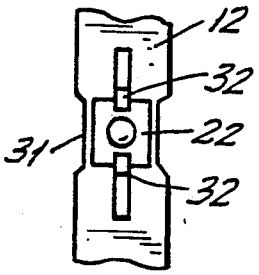
FIG. 1.
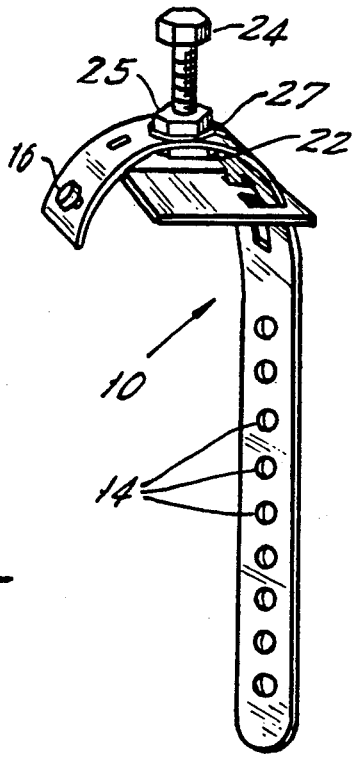
FIG. 4.
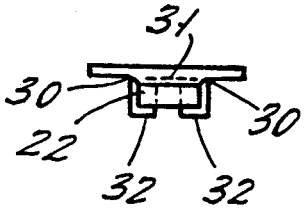
FIG. 7.
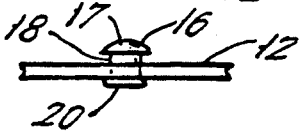
FIG. 5.
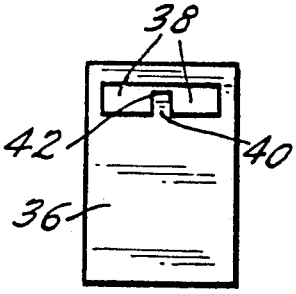
FIG. 6.
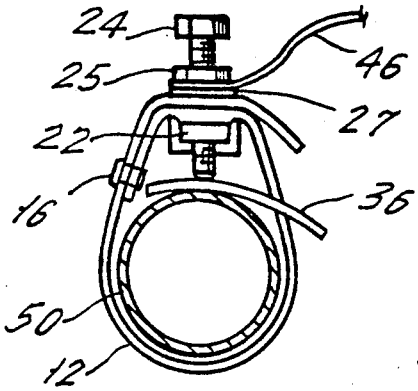
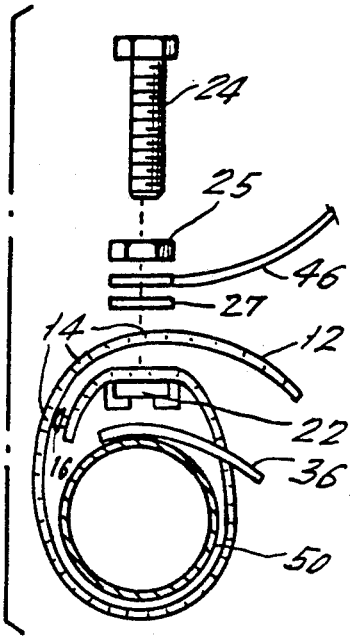
FIG. 8.

GROUNDING STRAP

BACKGROUND OF THE INVENTION

The present invention relates to grounding straps, in particular to flexible grounding straps made of metal, typically copper, which can be bent around a ground member, for example a metallic rod, pipe or conduit.

Flexible metallic grounding straps are known. One example is described in U.S. Pat. No. 4,591,229, which discloses a flexible metallic grounding strap useful, for example, to ground a circuit to a pipe, conduit or rod.

The grounding straps known from the prior art suffer from several disadvantages. For example, the strap known from U.S. Pat. No. 4,591,229 uses a circular shaped nut into which the strap tightening screw is threaded. The nut is secured to the strap by a pressure deformation of a collar which is received in a hole in the strap. This pressure deformation deforms the collar so that it overlaps the strap material surrounding the hole. This is disadvantageous because often the nut will come loose and thus will turn in the hole in which it is received in the strap, and it is then difficult to securely tighten the screw into the nut.

SUMMARY OF THE INVENTION

It is an object of the present invention to provide an improved flexible grounding strap which does not suffer from the disadvantages of the prior art strap.

The above and other objects of the present invention are achieved by a grounding strap comprising a strap of flexible, electrically conductive material, the strap having a plurality of holes therethrough spaced equidistantly along a portion of the strap; a threaded nut fastened to the strap at an aperture in the strap at a location near one end thereof; a projection near said one end for engaging a hole in the strap when the strap is wrapped around a grounded member such that the portion with the hole engaging the projection is on top of the portion of the strap having the projection; the holes in said strap being spaced so that when a first hole in the strap is above the projection, a second hole in the strap is approximately above the threaded nut; a separate member loosely fastened to the strap and positioned near the nut and being arranged such that a surface of the member is disposed below the nut; and the nut receiving a tightening screw, whereby when the strap is wrapped about the grounded member, the screw is insertable through the second hole and screwable into the nut so as to bear down on the surface of the member, forcing the nut away from the member and tightening the strap around the grounded member.

Other objects, features and advantages of the invention will be apparent from the following detailed description.

BRIEF DESCRIPTION OF THE DRAWINGS

The invention will now be described in greater detail in the following detailed description with reference to the drawings in which:

FIG. 1 is a perspective view of the ground strap according to the present invention prior to its fastening to the grounding member;

FIG. 2 is a plan view of the grounding strap according to the present invention;

FIG. 3 is a bottom view of a portion of the grounding strap shown in FIG. 2;

FIG. 4 is a side view of a portion of the ground strap shown in FIGS. 2 and 3;

FIG. 5 is a portion of the grounding strap shown in FIG. 2;

FIG. 6 is a side view of the grounding strap according to the present invention shown assembled to a grounded member;

FIG. 7 is a side view of a portion of the grounding strap; and

FIG. 8 shows the grounding strap in exploded view prior to tightening around the grounded member.

DETAILED DESCRIPTION OF THE INVENTION

With reference now to the drawings, the ground strap according to the invention is shown generally by reference numeral 10. The grounding strap includes a metallic strap, preferably made of a good conductive material such as copper. The strap 12 includes a plurality of holes therethrough 14. At one end, a button member 16 is riveted through an opening in the strap 12. The button member is shown in more detail in FIG. 7. As shown in FIG. 7, the button has a mushroom cap shape, with a head 17 having a slightly greater width than the shank 18. The shank 18 is riveted to the strap 12 at 20. Near the end with the button 16, a nut 22 having a thread for engaging a tightening bolt 24 is cinched to the strap 12 by forming indentations in the strap at 26 thereby to form a "cage" for the nut. The nut must be somewhat narrower than the width of the strap. FIGS. 3 and 4 show details of the way the nut is fastened to the strap. In order to hold the nut 22 securely to the strap, slots 28 are cut or pressed into the strap 12, with the pieces of material 32 cut out of the slots 28 in the strap 12 kept connected to the strap along one edge of the cut 30. The pieces of material 32 thereafter are bent around the nut 22 as shown in FIGS. 3 and 4. FIG. 3 shows a bottom view of the nut clamped to the strap 12 by the portions 32 as well as the flap portions 31 being pressed into the sides of the strap 12 at the indentations 26. This method securely holds the nut 22 to the strap, preventing it from turning when the tightening bolt 24 is turned. The pieces of material 32 and the flap portions 31 both prevent the nut from turning, while the material pieces 32 prevent the nut from falling away from the strap.

The strap 12 also includes another elongated rectangular aperture 34, which receives a rectangular member 36. The rectangular member 36 is shown in greater detail in FIG. 5, and includes an aperture 38, having a portion 40 of the rectangular member 36 not cut out of the aperture 38. The portion 40 is connected to the remainder of the member 36 only along one side, and is disconnected but abuts against the member 36 at side 42. This allows the member 36 to be assembled into the rectangular slot 34 in strap 12 by bending the small projection 40 out of the plane of the member 36, and thereafter sliding the member 36 onto end 44 of the strap 12, with the projection 40 thereafter being bent back into the plane of the member 36 when it is aligned with the aperture 34 to maintain the member 36 in position in the aperture 34. Once the projection 40 is bent back into the plane of the member 36 with the projection 40 extending through the slot 34, the member 36 is free for slidable movement with respect to the strap 12 limited by the extent of the length of the slot 34.

FIG. 6 shows the grounding strap assembled to a pipe 50. FIG. 8 shows the strap after it is wrapped about pipe 50, but before assembly of tightening bolt 24 thereto. The member 36 as well as the strap 12 are first positioned on the pipe such that the portion 36 is below the nut 22. The member 36, positioned between the bolt 24 and the pipe 50, helps in securing a good electrical connection as well as minimizing damage to the pipe 50 surface. The strap 12 is thereafter wrapped around the pipe 50 as closely as possible, with the button 16 being inserted into the hole 14 which causes the tightest hand or manual wrap of the strap 12 around the pipe 50. The holes 14 are spaced such that once the button is in a position to be received in a hole 14, another hole 14 will approximately line up with the opening in the strap 12 at the nut 22. Thereafter, the tightening bolt 24, preferably having a locking nut 25 thereon, is inserted through a washer 27 and screwed into the aperture in the strap at the nut 22 and threaded into the nut 22. The tightening bolt 24 is thereafter screwed down on the pipe 50, causing the strap 12 to tighten around the pipe 50. As the nut 22 is driven upward, the end of the strap having the hole 14 through which bolt 24 is disposed is caused also to move away from pipe 50, thereby tightening the strap 12 about the pipe. The tightening of the strap 12 around the pipe 50 and the turning of the bolt 24 onto the member 36, causes a good ground connection to be obtained between the pipe 50 and the strap 12, as well as between the pipe 50, the member 36 and the locking bolt 24. A cable 46 to be grounded is secured, preferably via an eyelet, placed between the locking nut 25 and the washer 27.

When the bolt 24 is tightened, stressing the strap 12, the button 16 will tend to snap into the hole 14, although it need not snap into the hole 14. Tightening bolt 24 can be made of any conductive material, but preferably comprises copper also.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A grounding strap comprising:

a strap of flexible, electrically conductive material, the strap having a plurality of holes therethrough spaced equidistantly along a portion of the strap;

a threaded nut fastened to the strap at an aperture in the strap at a location near one end thereof, the nut being held to the strap by a portion of the strap;

a projection near said one end for engaging a hole in the strap when the strap is wrapped around a grounded member such that the portion of the strap with the hole engaging the projection is on top of the portion of the strap having the projection;

the holes in said strap being spaced so that when a first hole in the strap is above the projection, a second hole in the strap is approximately above the threaded nut;

a member separate from an fastened to the strap and positioned near the nut and being arranged such that a surface of the member is disposed below the nut; and the nut receiving a tightening screw, whereby when the strap is wrapped about the grounded member, the screw is insertable through the second hole and screwable into the nut so as to bear down on the surface of the member, forcing the nut upwardly away from the member and tightening the strap around the grounded member.

2. The grounding strap of claim 1, wherein the member includes an aperture therein having a projection extending across the aperture and connected to the member only on one side, the projection being deformable out of the plane of the member, to allow the strap to be inserted into the aperture, the strap having a further aperture for receiving the projection after the projection is formed back into the plane of the member, thereby maintaining the member loosely in position on the strap at the aperture.

3. The grounding strap of claim 1, further comprising a locking nut threaded onto said screw and a washer below the locking nut, a grounding cable being received between the locking nut and the washer.

4. The grounding strap of claim 1, wherein the projection is mushroom shaped, with the head of the mushroom being slightly larger than the diameter of the holes.

5. The grounding strap of claim 1, wherein the nut has a width less than the width of the strap, edges of the strap extending past the nut being pressed about the nut to secure the nut in place on the strap.

6. The grounding strap of claim 5, including cut portions of the strap cut away except on one side of said portions, said portions being bent down about sides of the nut and bent again to extend below the nut to secure the nut to the strap.

7. The grounding strap of claim 2, wherein the member is rectangular in shape.

8. The grounding strap of claim 2, wherein the strap and member comprise copper.

9. A grounding strap comprising:

a strap of flexible, electrically conductive material, the strap having a plurality of holes therethrough spaced equidistantly along a portion of the strap;

a threaded nut fastened to the strap at an aperture in the strap at a location near one end thereof, said nut having a width less than the width of the strap, edges of the strap extending past the nut being pressed about the nut to secure the nut in place on the strap, portions of the strap being cut away except on one side of said portions, said portions being bent down about sides of the nut and extending below the nut to secure the nut to the strap;

a projection near said one end for engaging a hole in the strap when the strap is wrapped around a grounded member such that the portion of the strap with the hole engaging the projection is on top of the portion of the strap having the projection;

the holes in said strap being spaced so that when a first hole in the strap is above the projection, a second hole in the strap is approximately above the threaded nut;

a member fastened to the strap and positioned near the nut and being arranged such that a surface of the member is disposed below the nut; and the nut receiving a tightening screw, whereby when the strap is wrapped about the grounded member, the screw is insertable through the second hole and screwable into the nut so as to bear down on the surface of the member, forcing the nut upwardly away from the member and tightening the strap around the grounded member.

10. The grounding strap of claim 9, wherein the member is a separate piece loosely fastened to the strap, the member including an aperture therein having a projection extending across the aperture and connected to the member only on one side, the projection being deformable out of the plane of the member, to allow the strap to be inserted into the aperture, the strap having a further aperture for receiving the projection after the projection is formed back into the plane of the member, thereby maintaining the member loosely in position on the strap at the aperture.

11. The grounding strap of claim 9, further comprising a locking nut threaded onto said screw and a washer below the locking nut, a grounding cable being received between the locking nut and the washer.

12. The grounding strap of claim 9, wherein the projection is mushroom shaped, with the head of the mushroom being slightly larger than the diameter of the holes.

13. The grounding strap of claim 10, wherein the member is rectangular in shape.

14. The grounding strap of claim 10, wherein the strap and member comprise copper.

* * * * *